US009704645B2

(12) United States Patent
Sugimoto

(10) Patent No.: US 9,704,645 B2
(45) Date of Patent: Jul. 11, 2017

(54) COIL MANUFACTURING APPARATUS

(71) Applicant: NITTOKU ENGINEERING CO., LTD., Saitama (JP)

(72) Inventor: Shinji Sugimoto, Saitama (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 0 days.

(21) Appl. No.: 14/781,571

(22) PCT Filed: Mar. 19, 2014

(86) PCT No.: PCT/JP2014/057600
§ 371 (c)(1),
(2) Date: Sep. 30, 2015

(87) PCT Pub. No.: WO2014/167970
PCT Pub. Date: Oct. 16, 2014

(65) Prior Publication Data

US 2016/0049239 A1 Feb. 18, 2016

(30) Foreign Application Priority Data

Apr. 12, 2013 (JP) ..... 2013-083553

(51) Int. Cl.
*H01F 41/04* (2006.01)
*H01F 41/064* (2016.01)
*H01F 41/082* (2016.01)

(52) U.S. Cl.
CPC ..... *H01F 41/04* (2013.01); *H01F 41/064* (2016.01); *H01F 41/082* (2016.01)

(58) Field of Classification Search
CPC ..... H01F 41/04; H01F 41/064; H01F 41/082
USPC ..... 242/439.1
See application file for complete search history.

(56) References Cited

U.S. PATENT DOCUMENTS 3,759,454 A * 9/1973 Bernard ..... H01R 43/033 242/439.1
3,788,367 A * 1/1974 Ackerman ..... H01R 43/033 140/124
3,822,834 A * 7/1974 Fjarlie ..... H02G 11/02 242/386

(Continued)

FOREIGN PATENT DOCUMENTS

JP 2007-266578 A 10/2007
JP 2012-080037 A 4/2012

(Continued)

*Primary Examiner* — Emmanuel M Marcelo
*Assistant Examiner* — Michael Gallion
(74) *Attorney, Agent, or Firm* — Rabin & Berdo, P.C.

(57) ABSTRACT

A coil manufacturing apparatus 10 includes: a nozzle configured to feed a wire; a take-up jig configured to take up, through rotation, the wire fed from the nozzle; a cylindrical inner cutter tube that is provided coaxially with the take-up jig and is configured to rotate together with the take-up jig, the cylindrical inner cutter tube comprising a first slit that is formed so as to extend in an axial direction, the first slit being configured that the wire is inserted through; and an immovable outer cutter tube that is provided so as to be superimposed on an outside of the cylindrical inner cutter tube, the immovable outer cutter tube comprising a second slit that is formed so as to extend in the axial direction, the second slit being configured that the wire is inserted through.

4 Claims, 14 Drawing Sheets

(56) References Cited

U.S. PATENT DOCUMENTS

| | | | | |
|---|---|---|---|---|
| 4,436,190 | A * | 3/1984 | Wentzell | B65H 75/4449 191/12.2 R |
| 4,565,333 | A * | 1/1986 | Meneian | H02G 11/02 242/365.2 |
| 4,724,604 | A * | 2/1988 | Kawazoe | H01F 41/04 29/522.1 |
| 6,102,324 | A * | 8/2000 | Farrow | H01F 41/076 242/437.2 |
| 6,626,392 | B2 * | 9/2003 | Kajita | H02K 15/095 242/432.2 |
| 6,679,449 | B2 * | 1/2004 | Sugiuchi | H01F 41/09 242/439.1 |
| 7,614,579 | B2 * | 11/2009 | Asano | H01F 41/082 242/437.3 |
| 9,099,851 | B2 * | 8/2015 | Berg | H02G 1/10 |
| 2003/0168547 | A1 * | 9/2003 | Komuro | H02K 15/085 242/432.5 |
| 2009/0090807 | A1 * | 4/2009 | Nomura | H01F 41/127 242/416 |
| 2015/0243436 | A1 * | 8/2015 | Kondo | H02K 15/085 29/605 |
| 2016/0155553 | A1 * | 6/2016 | Hayashi | H01F 5/02 335/299 |

FOREIGN PATENT DOCUMENTS

| | | |
|---|---|---|
| TW | 457860 U | 10/2001 |
| TW | M253762 U | 12/2004 |

* cited by examiner

COIL MANUFACTURING APPARATUS

TECHNICAL FIELD

The present invention relates to a coil manufacturing apparatus for manufacturing coils by taking up a wire fed from a nozzle.

BACKGROUND ART

Hitherto, as a chip coil to be used, for example, in small electronic devices, there has been known a chip coil obtained by preparing a coil by winding a wire around a winding drum portion of a core having flange portions at both end portions thereof, and fixing end portions of the wire to electrodes formed on the flange portions of the core. JP 2007-266578 A discloses a chip coil manufacturing apparatus including a wire feeding machine for feeding a wire with a constant tension from a nozzle, and take-up jig that supports a core and turn together with the core so that the wire fed from the nozzle is taken up around the turned core.

In this coil manufacturing apparatus, the core is gripped with the take-up jig, and the take-up jig is turned together with the core. A leading end portion of the wire fed from the nozzle is held with a wire holding member, and is moved to one flange portion side. Then, the wire fed from the nozzle is wound around the core. In this way, the wire is spooled. After the spooling is finished, the nozzle is moved to another flange portion side, on which the electrodes are formed, and a winding-finish portion of the wire is drawn to the another flange portion side.

In accordance with movement of the nozzle, the wire holding member is moved so that the leading end portion of a winding-start portion of the wire, which is drawn from the one flange portion side, is moved to the another flange portion side, on which the electrodes are formed. Then, both the end portions of the wire are fixed by soldering to the electrodes formed on the another flange portion. After the end portions of the wire are fixed to the electrodes, the nozzle and the wire holding member are spaced away from the core so that the wire is torn off in a vicinity of the electrodes.

In the related-art coil manufacturing apparatus, the nozzle for feeding the wire, and the wire holding member for holding the winding-start portion of the wire are moved to guide the wire to the electrode side or to tear off the wire.

However, only the control of the movement of the nozzle and the wire holding member may result in an inaccurate process of the wire. Thus, until both the end portions are each cut into a predetermined length, processes such as the soldering are not executed. JP 2012-80037 A discloses a wire cutting apparatus for cutting a wire by electrically or hydraulically moving a nipper device so as to nip the wire between a pair of cutting blades of the nipper device.

SUMMARY OF INVENTION

However, the wire cutting apparatus disclosed in JP 2012-80037 needs a relatively large triaxial movement mechanism so as to move the nipper device. Thus, the apparatus as a whole may be increased in size.

In particular, in recent years, at the time of manufacturing what is called an α-winding coil having the winding-start portion and the winding-finish portion of the wire each positioned on an outer periphery of the coil, a length of each of the winding-start portion and the winding-finish portion of the wire tends to be shortened. In other words, the wire needs to be cut at positions close to the coil. In order to cut the wire at the positions close to the coil, the nipper device needs to be moved close to the coil by the triaxial movement mechanism. At this time, in order to keep the coil and the nipper device out of contact with each other, the movement by the triaxial movement mechanism may be complicated. As a result, an excessively long time period may be needed for processes on the wire.

It is an object of the present invention to downsize a coil manufacturing apparatus capable of cutting a winding-start portion or winding-finish portion of a wire of a coil swiftly into a predetermined length.

According to one aspect of the present invention, a coil manufacturing apparatus includes: a nozzle configured to feed a wire; a take-up jig configured to take up, through rotation, the wire fed from the nozzle; a cylindrical inner cutter tube that is provided coaxially with the take-up jig and is configured to rotate together with the take-up jig, the cylindrical inner cutter tube comprising a first slit that is formed so as to extend in an axial direction, the first slit being configured that the wire is inserted through; and an immovable outer cutter tube that is provided so as to be superimposed on an outside of the cylindrical inner cutter tube, the immovable outer cutter tube comprising a second slit that is formed so as to extend in the axial direction, the second slit being configured that the wire is inserted through.

DESCRIPTION OF EMBODIMENT

With reference to the drawings, description is made of a coil manufacturing apparatus according to an embodiment of the present invention.

Figure 1:
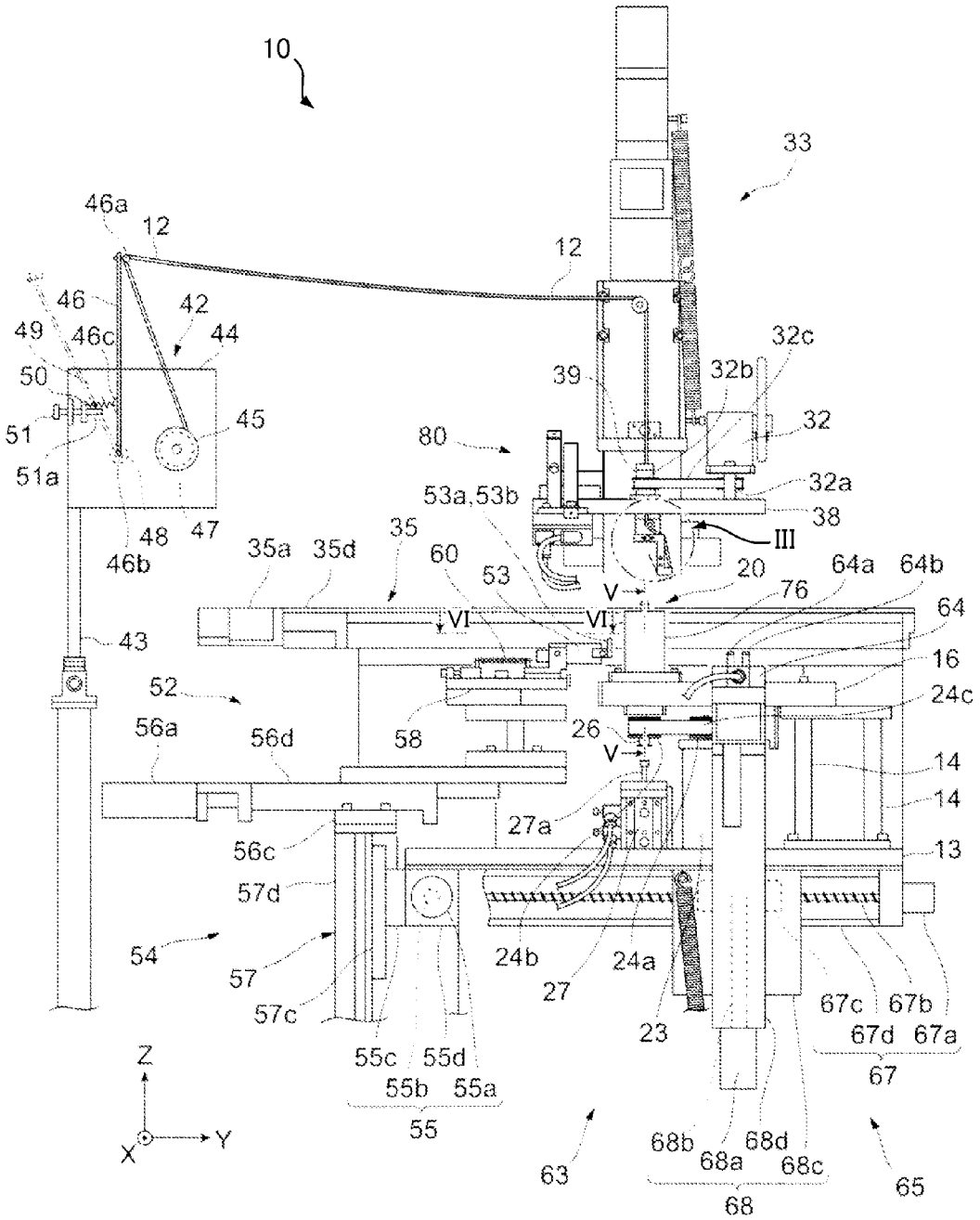
FIG. 1 is a front view of a coil manufacturing apparatus according to an embodiment of the present invention.
Figure 2:
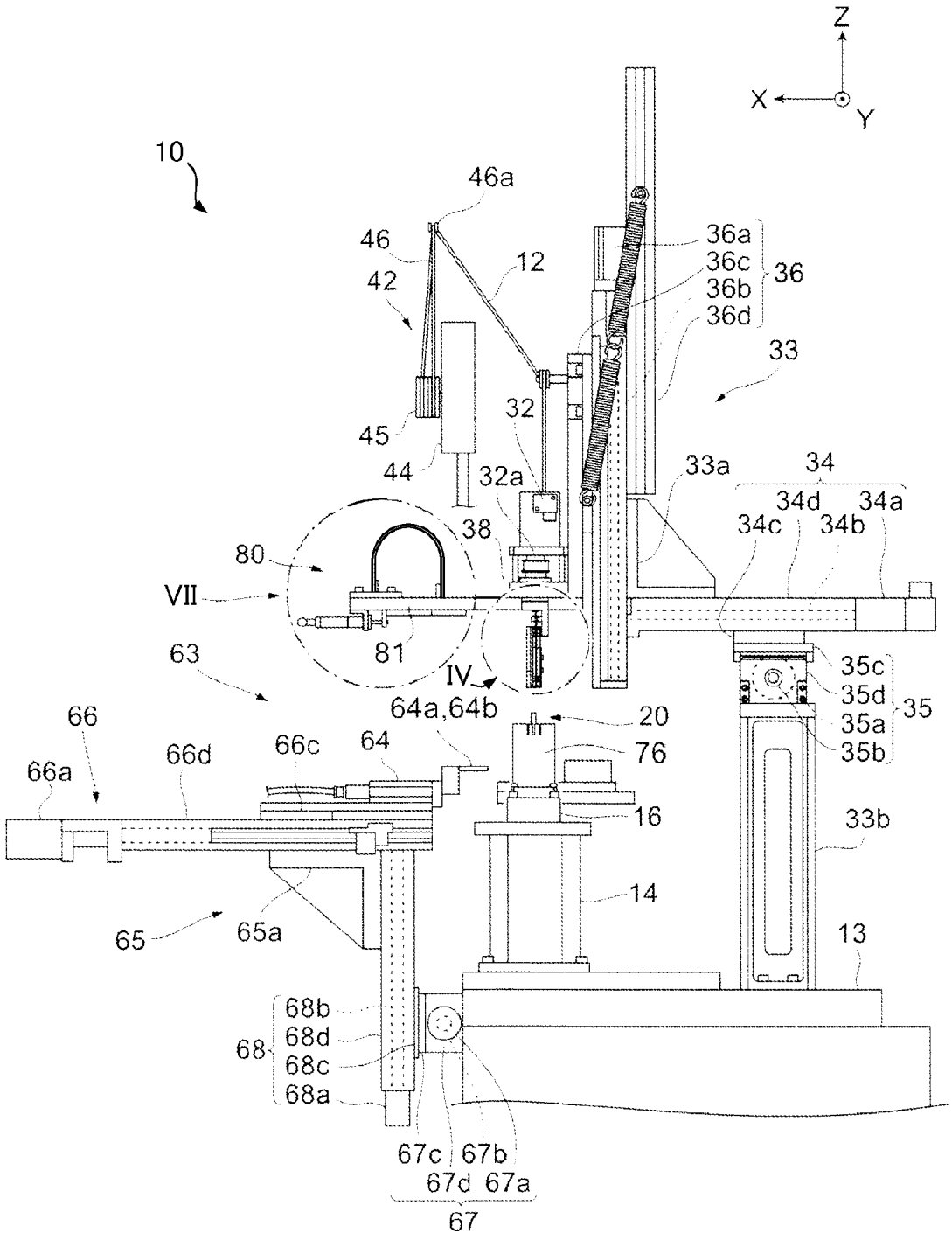
FIG. 2 is a side view of the coil manufacturing apparatus of FIG. 1.

FIGS. 1 and 2 illustrate a coil manufacturing apparatus 10. It should be noted that three X-, Y-, and Z-axes orthogonal to each other are defined. The X-axis extends in a horizontal front-and-rear direction, the Y-axis extends in a horizontal lateral direction, and the Z-axis extends in a perpendicular direction.

Figure 5:
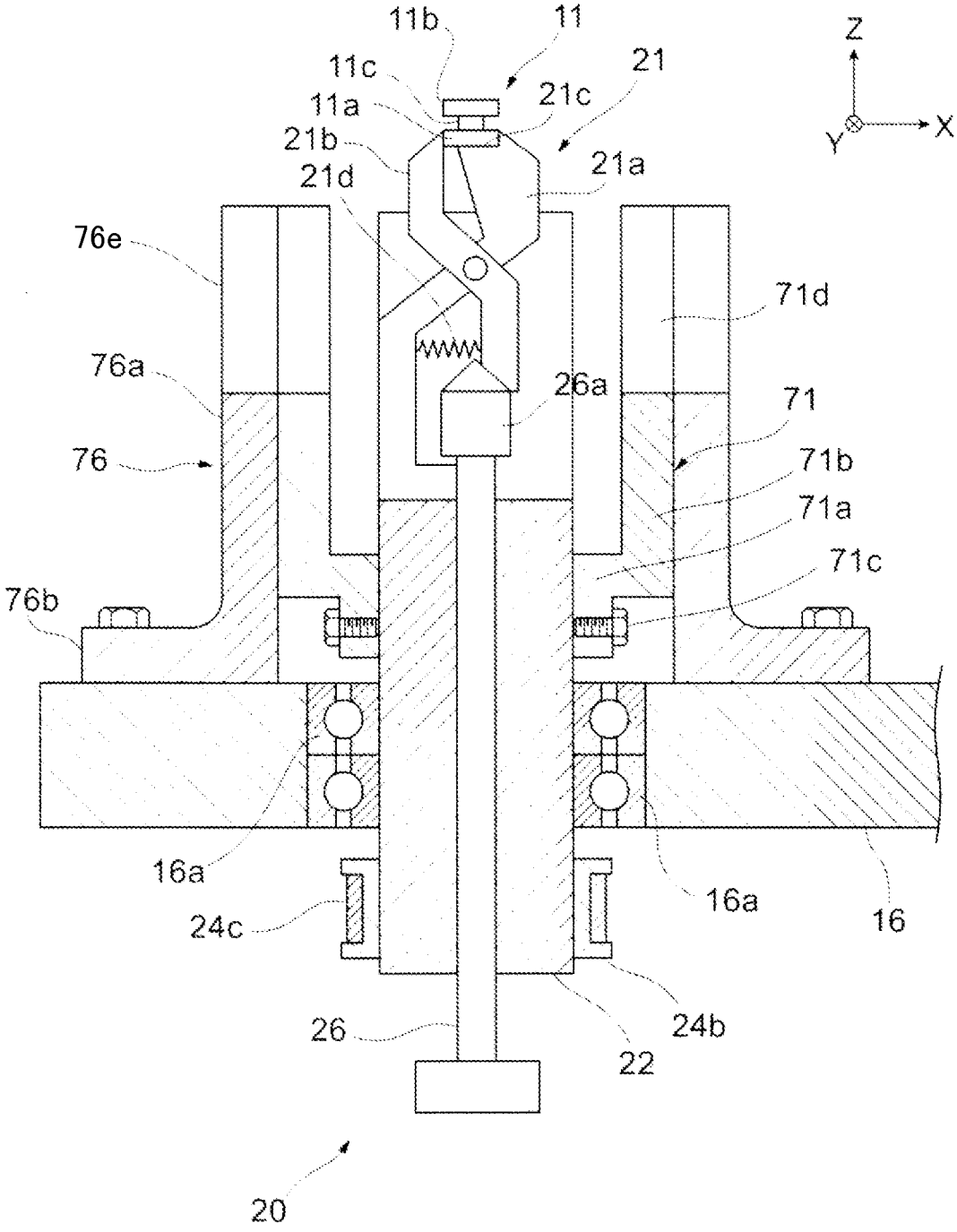
FIG. 5 is a sectional view taken along the line V-V in FIG. 1, for illustrating a take-up jig.

The coil manufacturing apparatus 10 includes a take-up jig 20 for taking up a wire 12 rotated therearound. As illustrated in FIG. 5, the take-up jig 20 includes a chuck 21 for gripping a core 11, and a spindle shaft 22 including the chuck 21 provided at a distal end thereof. The wire 12 is taken-up around the core 11 gripping by the chuck 21.

As illustrated in FIG. 5, rectangular flange portions 11*a* and 11*b* are formed at both end portions of a winding drum portion 11*c* of the core 11. Electrodes 11*d* and 11*e* are formed on both opposed sides of one flange portion 11*a* (FIG. 14), and electrodes are not formed on another flange portion 11*b*. The chuck 21 grips the other opposed sides of the one flange portion 11*a*, on which the electrodes are not formed.

The coil manufacturing apparatus 10 includes a horizontal pedestal 13, and a base 16 is provided horizontally above the pedestal 13 through intermediation of support posts 14.

As illustrated in FIG. 5, the spindle shaft 22 is a cylindrical member extending in a vertical direction, and the chuck 21 is provided on an upper side thereof. The spindle shaft 22 is pivotally supported with respect to the base 16 through intermediation of bearings 16*a*.

The chuck 21 provided on the upper side of the spindle shaft 22 includes a fixed side griping member 21*a* fixed to an upper end of the spindle shaft 22, and a movable side griping member 21*b* to be pivotally supported at its center substantially around a center of the fixed side griping member 21*a*.

The fixed side gripping member 21*a* and the movable side gripping member 21*b* are formed so as to intersect with each other substantially at the center around which the movable side gripping member 21*b* is pivotally supported. A cutout portion 21*c* capable of horizontally receiving the one flange portion 11*a* of the core 11 is provided at an upper edge of the fixed side gripping member 21*a*. An upper portion of the movable side gripping member 21*b* is shaped to be capable of holding the one flange portion 11*a*, which is set on the fixed side gripping member 21*a*, cooperatively with the fixed side gripping member 21*a*.

At a position below the pivot between the fixed side gripping member 21*a* and the movable side gripping member 21*b*, there is interposed a coil spring 21*d* for urging the fixed side gripping member 21*a* and the movable side gripping member 21*b* so that an interval therebetween is narrowed. In other words, the interval above the pivot between the fixed side gripping member 21*a* and the movable side gripping member 21*b* is narrowed by an urging force of the coil spring 21*d*. Thus, the one flange portion 11*a* set on the cutout portion 21*c* is gripped with the urging force of the coil spring 21*d*.

The coil manufacturing apparatus 10 includes a rotary mechanism for rotating the spindle shaft 22 together with the core 11 gripped by the chuck 21. The rotary mechanism includes a motor 23 mounted to the pedestal 13, and a first pulley 24*a* is provided to a rotary shaft thereof.

As illustrated in FIG. 5, a second pulley 24*b* is mounted to the spindle shaft 22 projecting downward with respect to the base 16.

A belt 24*c* is looped around the first pulley 24*a* and the second pulley 24*b*. When the motor 23 is driven, the spindle shaft 22 is rotated together with the core 11 through intermediation of the first pulley 24*a*, the belt 24*c*, and the second pulley 24*b*.

As illustrated in FIG. 5, along a center axis of the spindle shaft 22, an operating rod 26 is inserted to be vertically movable. To an upper end of the operating rod 26, in other words, to an upper portion of the operating rod 26, which projects upward with respect to the upper edge of the spindle shaft 22, a truncated conical operational element 26*a* that radially shrinks upward is mounted. A part on the fixed side gripping member 21*a* side of a lower end of the movable side gripping member 21*b* is held in contact with a conical surface of the operational element 26*a*. Thus, when the operating rod 26 is raised, lower parts with respect to the pivot of the movable side gripping member 21*b* are pulled away from the fixed side gripping member 21*a* against the urging force of the coil spring 21*d*. As a result, the interval above the pivot between the fixed side gripping member 21*a* and the movable side gripping member 21*b* is widened, and the core 11 is released from being held therebetween.

An actuator 27 for raising and lowering the operating rod 26 is mounted to the pedestal 13. Examples of the actuator 27 include what is called an air cylinder that causes a rod 27*a* to be moved in and out in conjunction with supply and exhaust of compressed air. The actuator 27 is mounted to the pedestal 13 in a manner that the rod 27*a* is directed upward and coaxial with the operating rod 26. When the rod 27*a* is raised, the operating rod 26 is raised in conjunction therewith to release the core 11 from being gripped by the chuck 21. When the rod 27*a* is lowered, the operating rod 26 is lowered in conjunction therewith to allow the core 11 to be gripped by the chuck 21.

As illustrated in FIGS. 1 to 4, the coil manufacturing apparatus 10 includes a wire feeding machine for feeding the wire 12 with a constant tension. The wire feeding machine includes a nozzle 31 through which the wire 12 is inserted, a rotary mechanism 32 for rotating the nozzle 31, a nozzle moving mechanism 33 for moving the nozzle 31 in the triaxial directions together with the rotary mechanism 32, and a tensioning device 42 for applying tension to the wire 12.

Figure 3:
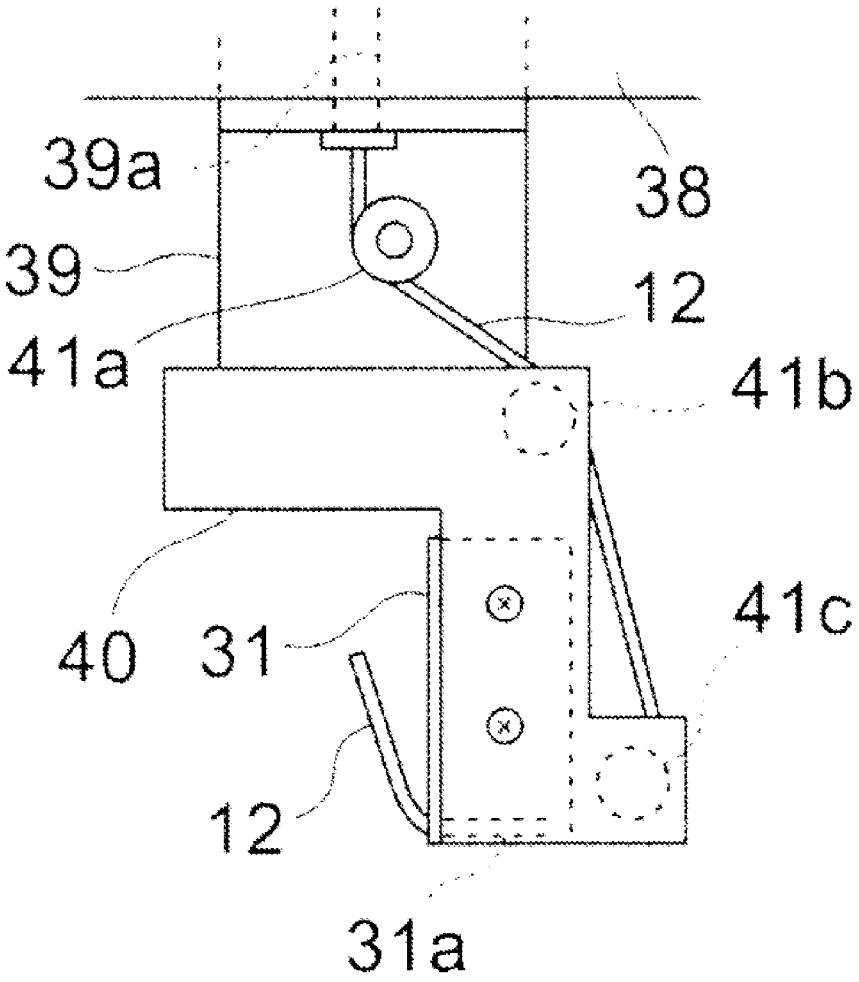
FIG. 3 is an enlarged view of the part III in FIG. 1.
Figure 4:
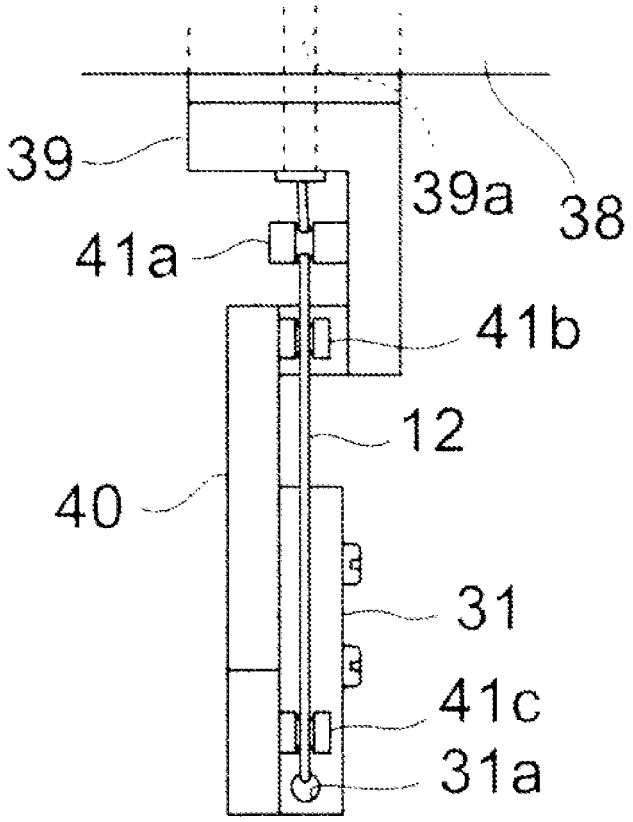
FIG. 4 is an enlarged view of the part IV in FIG. 2.

As illustrated in FIG. 3, the nozzle 31 is fixed to a rotary member 39 that is pivotally supported with respect to a support plate 38. The support plate 38 is horizontally supported by the nozzle moving mechanism 33. The rotary member 39 is pivotally supported with respect to the support plate 38 under a state in which a rotary axis thereof extends in the vertical direction. A substantially crank-shaped mounting member 40 is mounted to the rotary member 39 under the support plate 38. The nozzle 31 is fixed to a lower portion of the mounting member 40, which is displaced with respect to the rotary axis of the rotary member 39.

The nozzle 31 is a hexahedron, and a horizontal feed hole 31*a* through which the wire 12 is inserted is formed at a lower portion thereof. The feed hole 31*a* is formed in a region of from an outside of the rotary member 39 toward a rotation center of the rotary member 39. A distance from the rotation center to the nozzle 31 is set to be sufficient to surround the flange portions 11*a* and 11*b* (FIG. 5) of the core 11 with a circle formed by the nozzle 31 when the rotary member 39 is rotated.

At the rotation center of the rotary member 39, an insertion hole 39*a* through which the wire 12 is inserted is formed along the vertical direction. To the rotary member 39 and the mounting member 40, pulleys 41*a* to 41*c* for guiding the wire 12, which is inserted through the insertion hole 39*a*, to the feed hole 31*a* of the nozzle 31 are mounted. The wire 12 routed by the pulleys 41*a* to 41*c* is inserted from the outside into the feed hole 31*a* of the nozzle 31 toward the center of the rotary member 39.

As illustrated in FIGS. 1 and 2, the rotary mechanism 32 for rotating the nozzle 31 includes a motor 32 mounted to the support plate 38. A third pulley 32*a* is provided to a rotary shaft of the motor 32, and a fourth pulley 32*b* is mounted to the rotary member 39 projecting upward with respect to the support plate 38. A belt 32*c* is looped around the third pulley 32*a* and the fourth pulley 32*b*. When the motor 32 is driven, the rotary member 39 is rotated together with the nozzle 31 through intermediation of the third pulley 32*a*, the belt 32*c*, and the fourth pulley 32*b*. The nozzle moving mechanism 33 for moving the nozzle 31 in the triaxial directions together with the rotary mechanism 32 is capable of moving the support plate 38 in the triaxial directions with respect to the pedestal 13.

The nozzle moving mechanism 33 includes extension/retraction actuators 34 to 36 that extend and retract respectively in the X-axis, the Y-axis, and the Z-axis directions.

The extension/retraction actuators 34 to 36 of the nozzle moving mechanism 33 respectively include elongated box-shaped housings 34*d* to 36*d*, ball screws 34*b* to 36*b* that are provided so as to longitudinally extend in the housings 34*d* to 36*d* and rotationally moved by servo motors 34*a* to 36*a*, and followers 34*c* to 36*c* that are threadedly engaged with the ball screws 34*b* to 36*b*.

In the extension/retraction actuators 34 to 36, when the servo motors 34*a* to 36*a* are driven to rotate the ball screws 34*b* to 36*b*, the followers 34*c* to 36*c* threadedly engaged with the ball screws 34*b* to 36*b* are moved along the longitudinal directions of the housings 34*d* to 36*d*.

In order to allow the nozzle 31 to be moved in the Z-axis direction, the support plate 38 is mounted to the follower 36*c* of the Z-axis extension/retraction actuator 36 to be extended and retracted in the Z-axis direction. In order to allow the support plate 38 to be moved in the X-axis direction together with the Z-axis extension/retraction actuator 36, the housing 36*d* of the Z-axis extension/retraction actuator 36 is fixed to the housing 34*d* of the X-axis extension/retraction actuator 34 to be extended and retracted in the X-axis direction through intermediation of an L-shaped angle bar 33*a*.

In order to allow the support plate 38 to be moved in the Y-axis direction together with the X-axis extension/retraction actuator 34 and the Z-axis extension/retraction actuator 36, the follower 34*c* of the X-axis extension/retraction actuator 34 is fixed to the follower 35*c* of the Y-axis extension/retraction actuator 35 to be extended and retracted in the Y-axis direction. The housing 35*d* of the Y-axis extension/retraction actuator 35 is fixed to the pedestal 13 through intermediation of a support post 33*b*.

The servo motors 34*a* to 36*a* of the extension/retraction actuators 34 to 36 are connected to control output of a controller (not shown) for controlling those motors.

As illustrated in FIG. 1, the tensioning device 42 is capable of applying tension to the fed wire 12, and pulling back the wire 12. The tensioning device 42 includes a casing 44 set on an upper side of a mounting leg 43, and a drum 45 and a tension bar 46 provided on a side surface of the casing 44.

The wire 12 is wound around the drum 45. A feed control motor 47 for feeding the wire 12 by rotating the drum 45 is provided in the casing 44. The wire 12 fed from the drum 45 is guided to a wire guide 46*a* provided at a distal end of the tension bar 46. The wire 12, which has been guided to the wire guide 46*a*, is guided to the insertion hole 39*a* of the rotary member 39.

The tension bar 46 is turnable about a turning shaft 46*b* at a proximal end thereof. A turning angle of the turning shaft 46*b* is detected by a potentiometer 48 serving as turning angle detecting means received in the casing 44 and mounted to the turning shaft 46*b*. Detection output from the potentiometer 48 is input to the controller (not shown), and the control output from the controller is connected to the feed control motor 47.

To a predetermined position between the turning shaft 46*b* and the wire guide 46*a* of the tension bar 46, one end of a spring 49 serving as an elastic member for applying an urging force in a turning direction of the tension bar 46 is mounted through intermediation of a mounting bracket 46*c*. An elastic force corresponding to the turning angle is applied from the spring 49 to the tension bar 46.

Another end of the spring 49 is fixed to a moving member 50. The moving member 50 is threadedly engaged with a male thread 51*a* of a tension adjustment screw 51. The moving member 50 can be adjusted in position by rotating the male thread 51*a*. In other words, a fixed position of the another end of the spring 49 is displaceable, and hence the tension to be applied from the tension bar 46 to the wire 12 can be adjusted.

The controller (not shown) controls the feed control motor 47 so that the turning angle detected by the potentiometer 48 serving as the turning angle detecting means is adjusted to a predetermined angle.

In the tensioning device 42, the tension is applied from the spring 49 to the wire 12 through intermediation of the tension bar 46, and the drum 45 is rotated so as to cause the tension bar 46 to form the predetermined angle. Thus, the wire 12 is fed by a predetermined amount, and the tension of the wire 12 is maintained at a predetermined value.

The coil manufacturing apparatus 10 includes a wire retaining mechanism 52 for drawing and retaining the wire 12 from the nozzle 31 by a length corresponding to a predetermined number of turns. The wire retaining mechanism 52 includes a wire retention clamping device 53 capable of griping the wire 12, and a wire retention moving mechanism 54 for moving the wire retention clamping device 53 in the triaxial directions.

The wire retention clamping device 53 of the wire retaining mechanism 52 includes nipping pieces 53*a* and 53*b* (FIG. 6) that open and close in conjunction with supply or exhaust of compressed air, and the wire 12 fed from the nozzle 31 is gripped with the nipping pieces 53*a* and 53*b*. The wire retention clamping device 53 is provided to a moving plate 58 in a manner of extending in the Y-axis direction and facing the nozzle 31.

Distal ends of the nipping pieces 53*a* and 53*b* of the wire retention clamping device 53, which face the nozzle 31, are formed by being bent upward. The supply of the compressed air to the wire retention clamping device 53 and the exhaust of the compressed air from the wire retention clamping device 53 are controlled by the controller (not shown).

Figure 6:
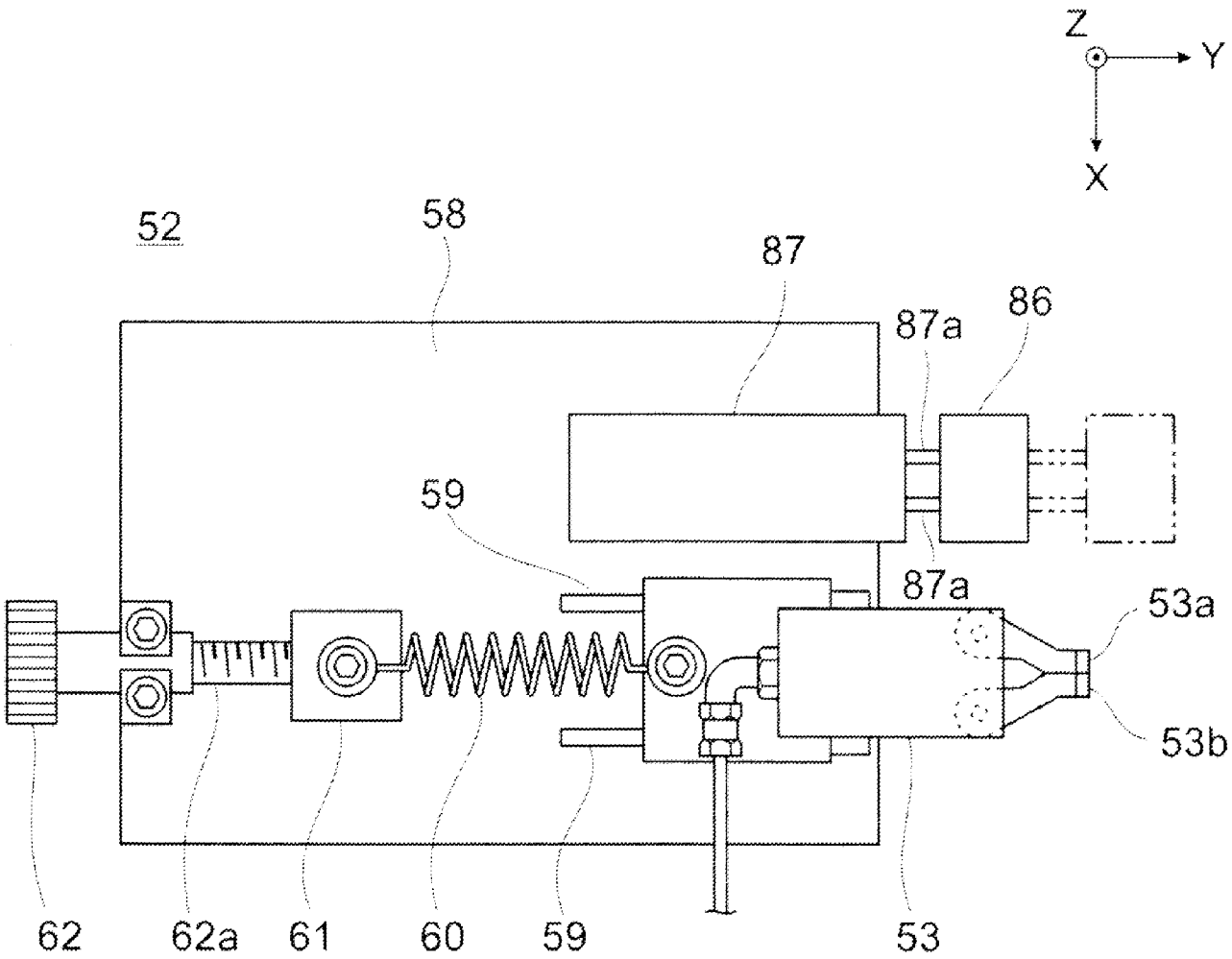
FIG. 6 is a sectional view taken along the line VI-VI in FIG. 1, for illustrating a wire retaining mechanism.

As illustrated in FIG. 6, rails 59 extending in the Y-axis direction are provided to the moving plate 58. Under a state in which the nipping pieces 53*a* and 53*b* are projected to the take-up jig 20 side (FIG. 1), the wire retention clamping device 53 is mounted to the rails 59 so as to be movable in the Y-axis direction. One end of a coil spring 60 is mounted to the wire retention clamping device 53, and another end of the coil spring 60 is fixed to a moving member 61.

The moving member 61 is threadedly engaged with a male thread 62*a* of a tension adjustment screw 62. The moving member 61 can be adjusted in position by rotating the male thread 62*a*.

The coil spring 60 urges the wire retention clamping device 53 in a direction in which the wire retention clamping device 53 is spaced away from the take-up jig 20. The wire retention moving mechanism 54 (FIG. 1) moves the moving plate 58 in the triaxial directions together with the wire retention clamping device 53.

The wire retention moving mechanism 54 has the same structure as that of the nozzle moving mechanism 33. Specifically, the wire retention moving mechanism 54 includes extension/retraction actuators 55 to 57 that extend and retract respectively in the X-axis, the Y-axis, and the Z-axis directions. The moving plate 58 to which the wire retention clamping device 53 is provided is mounted to a housing 56*d* of the Y-axis extension/retraction actuator 56 that is movable in the Y-axis direction. In order to allow the moving plate 58 to be moved in the Z-axis direction together with the Y-axis extension/retraction actuator 56, a follower 56*c* of the Y-axis extension/retraction actuator 56 is mounted to a housing 57*d* of the Z-axis extension/retraction actuator 57.

In order to allow the moving plate 58 to be moved in the X-axis direction together with the Y-axis extension/retraction actuator 56 and the Z-axis extension/retraction actuator 57, a follower 57*c* of the Z-axis extension/retraction actuator 57 is mounted to a follower 55*c* of the X-axis extension/retraction actuator 55. A housing 55*d* of the X-axis extension/retraction actuator 55 extends in the X-axis direction and is fixed to the pedestal 13.

Servo motors 55*a* to 57*a* of the extension/retraction actuators 55 to 57 are connected to the control output of the controller (not shown) for controlling those motors.

As illustrated in FIG. 2, the coil manufacturing apparatus 10 includes an end portion griping mechanism 63 for griping end portions of the wire 12 wound around the core 11 (FIG. 5). The end portion griping mechanism 63 similarly includes an end portion clamping device 64 capable of griping the wire 12, and a moving mechanism 65 for moving the end portion clamping device 64 in the triaxial directions.

As illustrated in FIG. 2, the end portion clamping device 64 of the end portion griping mechanism 63 includes nipping pieces 64*a* and 64*b* (FIGS. 13 and 14) that open and close in conjunction with supply or exhaust of compressed air. The nipping pieces 64*a* and 64*b* grip the end portion of the wire 12 wound around the core 11. Distal ends of the nipping pieces 64*a* and 64*b*, which face the take-up jig 20, are formed so as to be relatively thinner.

The supply of the compressed air to the end portion clamping device 64 and the exhaust of the compressed air from the end portion clamping device 64 are controlled by the controller (not shown).

The moving mechanism 65 for moving the end portion clamping device 64 in the triaxial directions has the same structure as those of the nozzle moving mechanism 33 and the wire retention moving mechanism 54. Specifically, the moving mechanism 65 includes extension/retraction actuators 66 to 68 that extend and retract respectively in the X-axis, the Y-axis, and the Z-axis directions.

The end portion clamping device 64 is mounted to a follower 66*c* of the X-axis extension/retraction actuator 66 of the moving mechanism 65. In order to allow the end portion clamping device 64 to be moved in the Z-axis direction together with the X-axis extension/retraction actuator 66, a housing 66*d* of the X-axis extension/retraction actuator 66 is mounted to a housing 68*d* of the Z-axis extension/retraction actuator 68 through intermediation of an angle member 65*a*.

In order to allow the end portion clamping device 64 to be moved in the Y-axis direction together with the X-axis extension/retraction actuator 66 and the Z-axis extension/retraction actuator 68, a follower 68*c* of the Z-axis extension/retraction actuator 68 is mounted to a follower 67*c* of the Y-axis extension/retraction actuator 67. A housing 67*d* of the Y-axis extension/retraction actuator 67 extends in the Y-axis direction and is fixed to the pedestal 13.

Servo motors 66*a* to 68*a* of the extension/retraction actuators 66 to 68 are connected to the control output of the controller (not shown) for controlling those motors.

As illustrated in FIG. 5, the coil manufacturing apparatus 10 includes a cylindrical inner cutter tube 71 provided coaxially with the take-up jig 20, and an outer cutter tube 76 provided so as to be superimposed on an outside of the inner cutter tube 71.

The inner cutter tube 71 includes a small diameter tubular portion 71*a* having an inner diameter slightly larger than an outer diameter of the spindle shaft 22, and a large diameter tubular portion 71*b* provided coaxially and continuously on an upper side of the small diameter tubular portion 71*a*. The spindle shaft 22 is fitted into the small diameter tubular portion 71*a*, and the inner cutter tube 71 is mounted to the spindle shaft 22 with screws 71*c* that are threadedly engaged in a radial direction with the small diameter tubular portion 71*a*.

The inner cutter tube 71 is mounted in a manner that an upper rim of the inner cutter tube 71, specifically, an upper rim of the large diameter tubular portion 71*b* is positioned lower than a lower edge of the core 11 held by the chuck 21. Slits 71*d* are formed so as to extend in an axial direction from the upper rim of the large diameter tubular portion 71*b*.

The slits 71*d* are configured to cut the wire 12 to be wound around the core 11. In the case described in this embodiment, three slits 71*d* are formed on each side in a diametrical direction, in other words, a total of six slits 71*d* are formed (FIGS. 10 to 13).

The outer cutter tube 76 includes a tubular body portion 76*a* to be superimposed, from the outside, on the large diameter tubular portion 71*b* of the inner cutter tube 71, and a flange portion 76*b* provided around a lower end of the tubular body portion 76*a*. The flange portion 76*b* is mounted to the base 16. An upper rim of the body portion 76*a* is formed so as to be substantially flush with the upper rim of the inner cutter tube 71.

Slits 76*d* are similarly formed so as to extend in the axial direction from the upper rim of the body portion 76*a*. The slits 76*d* are also configured to cut the wire 12 to be wound around the core 11. Correspondingly to the slits 71*d* formed in the inner cutter tube 71, three slits 76*d* are formed on each side in the diametrical direction (FIGS. 10 to 13).

Figure 10:
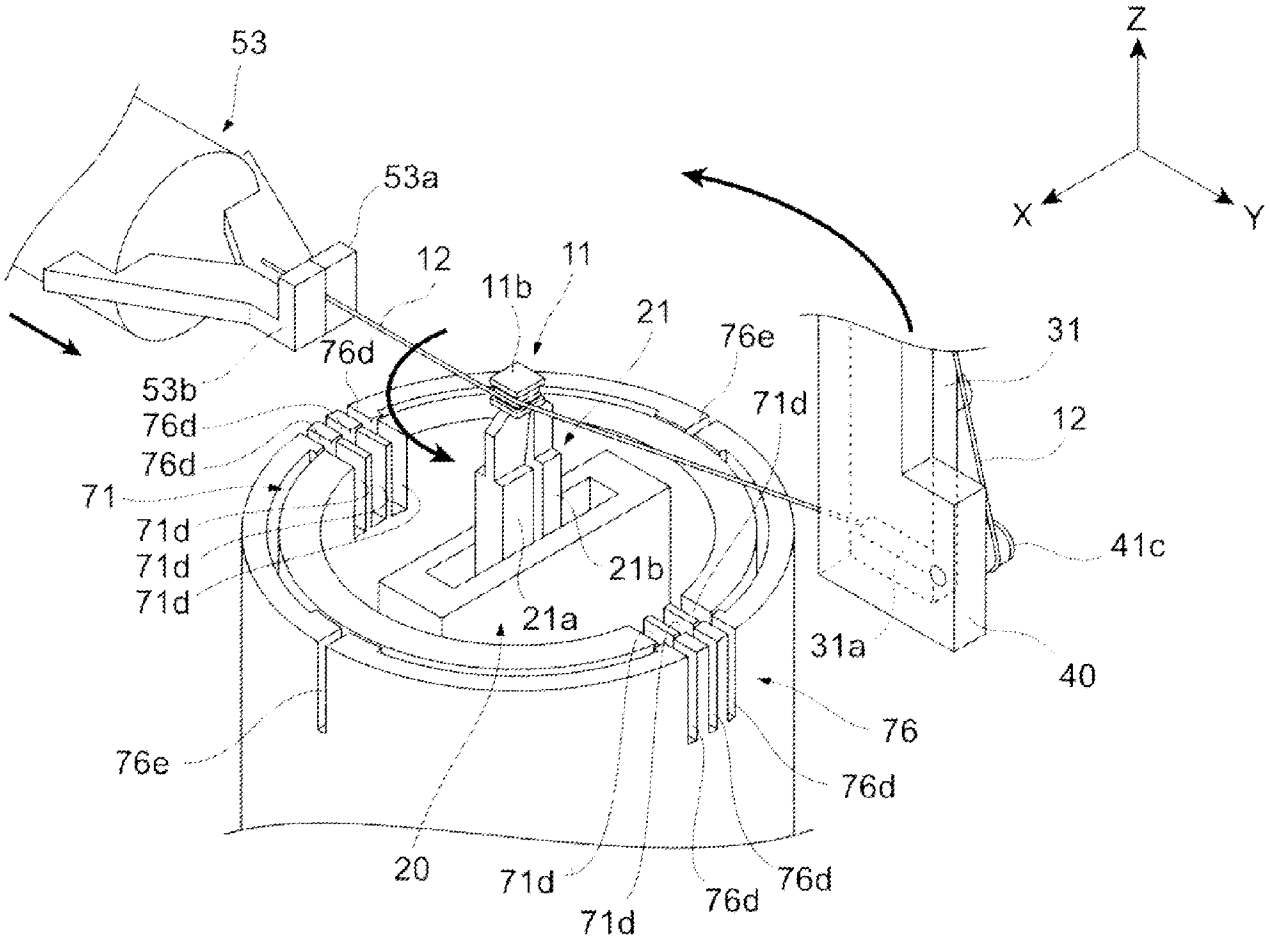
FIG. 10 is a perspective view of a state in which an α-winding coil is wound.

As illustrated in FIG. 10, the slits 76*d* of the outer cutter tube 76 are formed along the Y-axis direction being a direction in which the wire retention clamping device 53 faces the slits 76*d*, in other words, a direction in which the rails 59 of the moving plate 58, to which the wire retention clamping device 53 is provided so as to be movable, are provided (FIG. 6).

In order to reliably keep contact between parts of an inner peripheral surface of the outer cutter tube 76, at which the slits 76*d* are formed, and an outer peripheral surface of the large diameter tubular portion 71*b* of the inner cutter tube 71, the parts of the outer cutter tube 76, at which the slits 76*d* are formed, swell on an inner periphery, in other words, are formed so as to be thick.

In order to allow the outer cutter tube 76 to be smoothly fitted onto the inner cutter tube 71, in the tubular body portion 76*a*, auxiliary slits 76*e* are formed along the X-axis direction, in other words, a direction orthogonal to the direction in which the slits 76*d* are formed on each side.

The auxiliary slits 76*e* are formed so as to keep the parts of the inner periphery, at which the slits 76*d* are formed, in contact with the outer periphery of the inner cutter tube 71 under a state in which widths thereof are expanded. In other words, the auxiliary slits 76*e* are formed so as to allow the parts, at which the slits 76*d* are formed, to be displaced radially outward. Thus, the parts of the inner peripheral surface, at which the slits 76*d* are formed, are reliably held in contact with the outer peripheral surface of the large diameter tubular portion 71*b* of the inner cutter tube 71.

Figure 14:
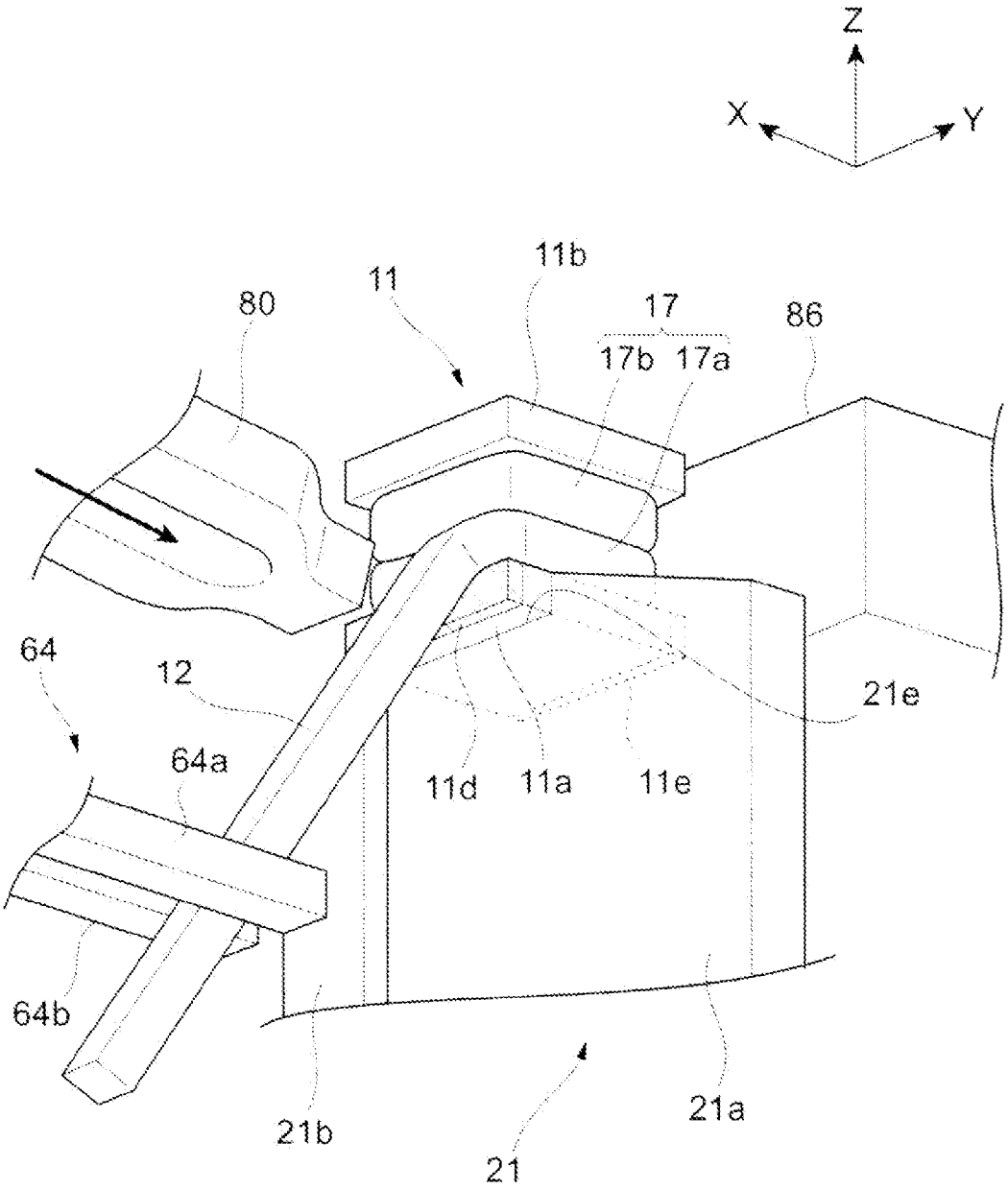
FIG. 14 is a perspective view of a state in which the cut winding-start portion of the wire is joined to an electrode.

The coil manufacturing apparatus 10 further includes joining means for joining the end portions of the wire 12 wound around the core 11 to the electrodes 11*d* and 11*e* (FIG. 14).

As illustrated in FIG. 14, the electrodes 11*d* and 11*e* of the core 11 are each formed of a solder layer on both sides of the one flange portion 11*a*. The joining means includes an electric heat iron 80 for soldering the wire 12 to the electrode 11*d* or 11*e* by heating the wire 12 held in contact with the electrode 11*d* or 11*e*.

Figure 7:
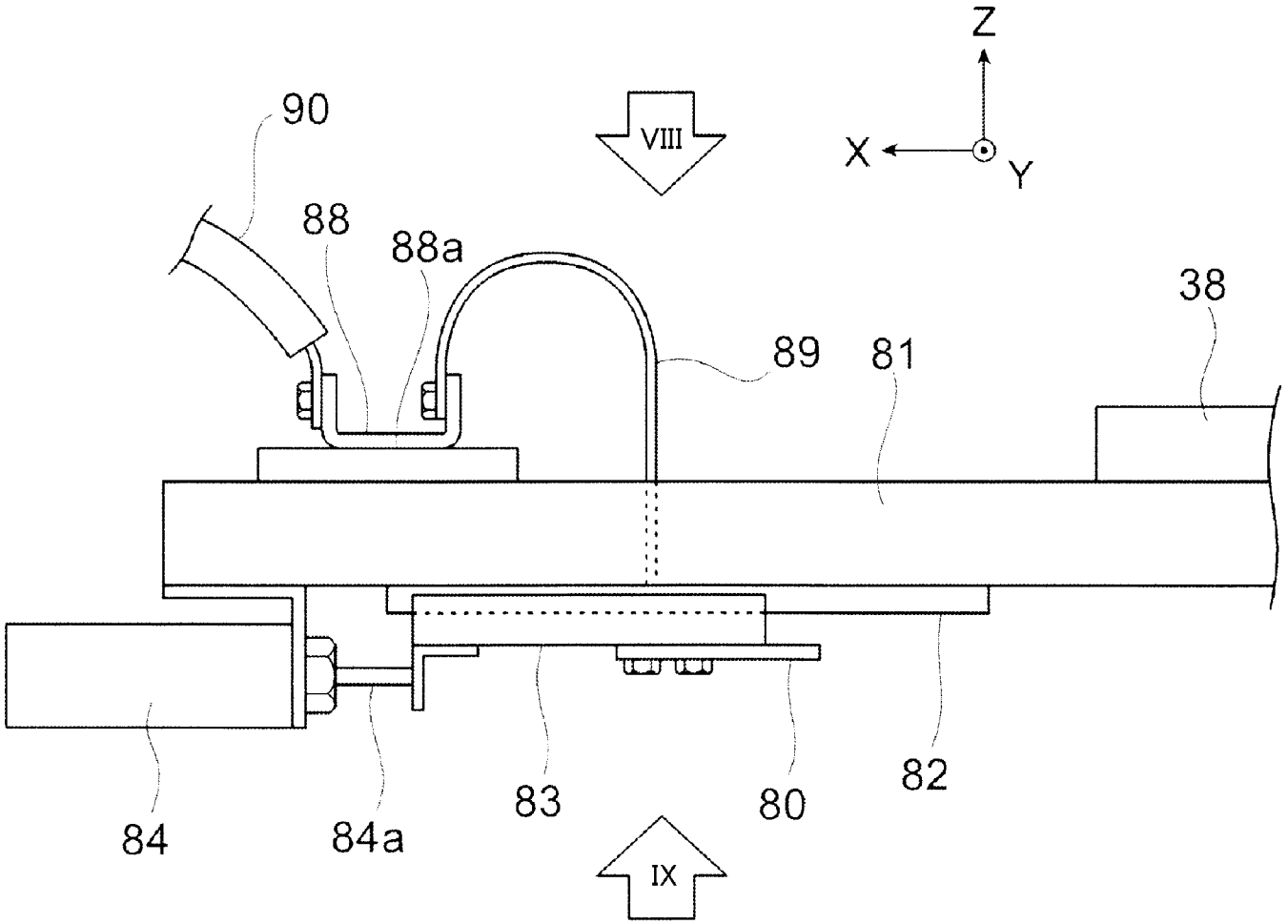
FIG. 7 is an enlarged view of the part VII in FIG. 2, for illustrating joining means.

As illustrated in FIG. 7, the electric heat iron 80 is mounted to the support plate 38 through intermediation of a mounting plate 81, and is movable in the triaxial directions together with the nozzle 31 by the nozzle moving mechanism 33 described above (FIG. 2).

Figure 8:
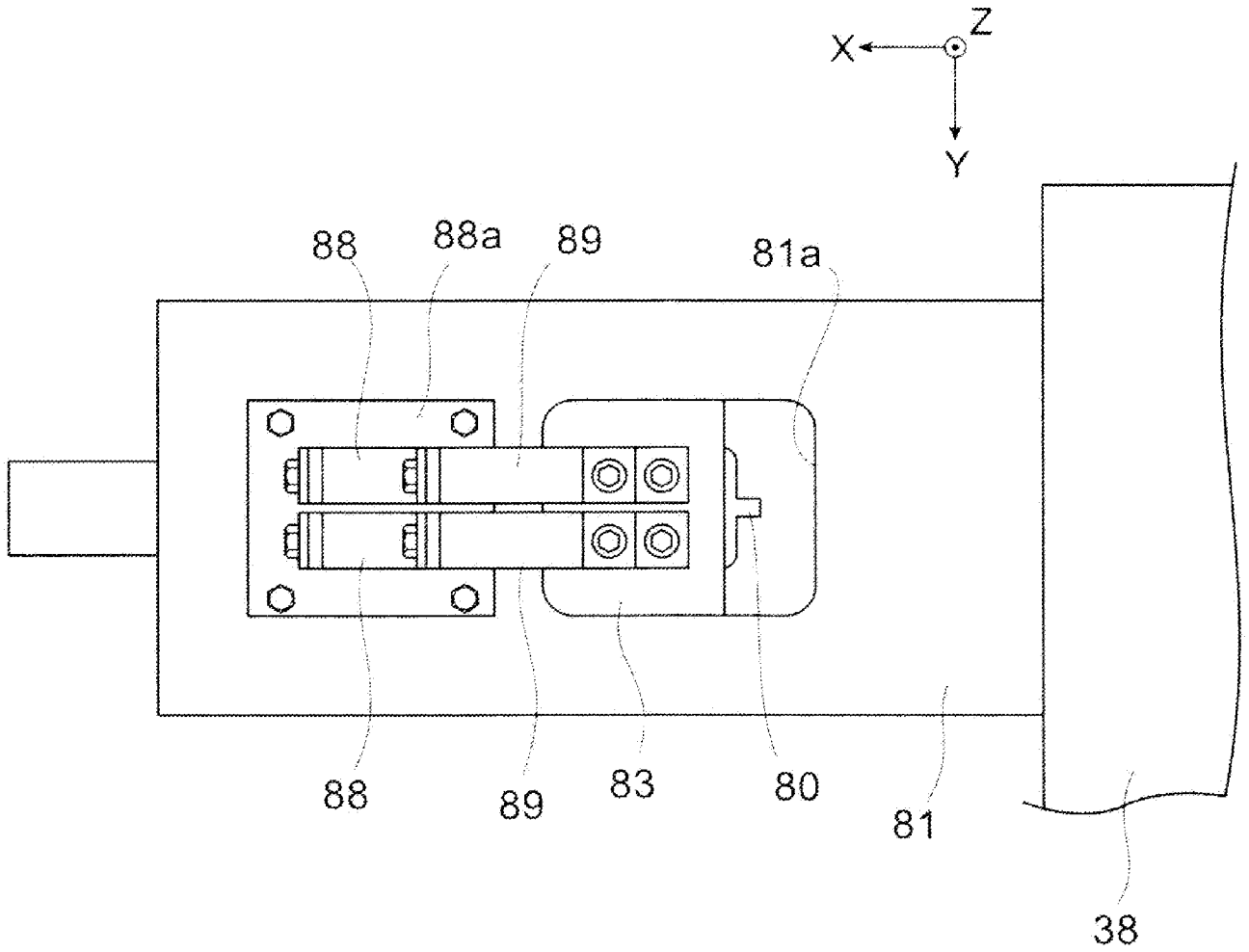
FIG. 8 is a view illustrating the joining means of FIG. 7 as viewed in the direction VIII.
Figure 9:
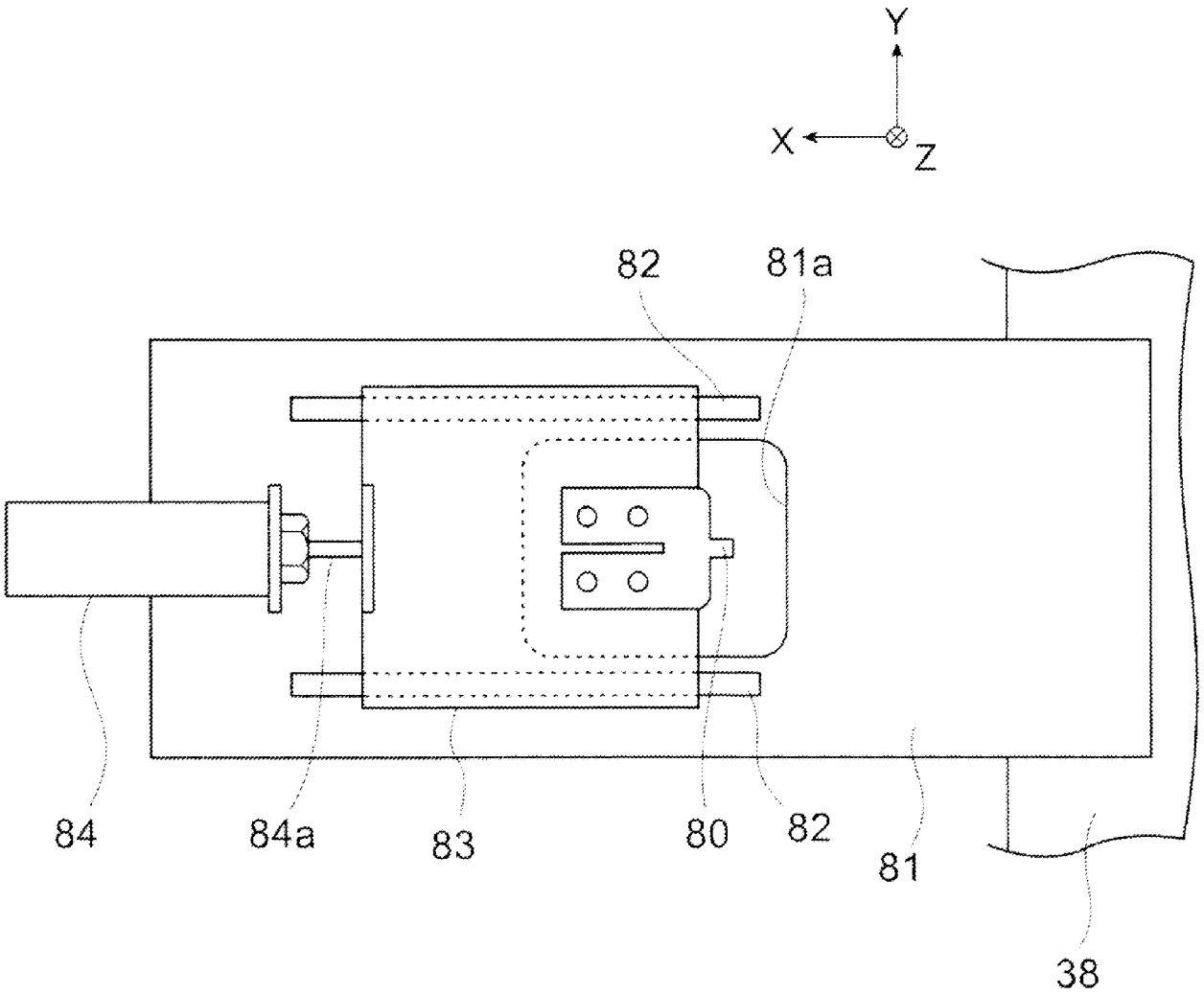
FIG. 9 is a view illustrating the joining means of FIG. 7 as viewed in the direction IX.

As illustrated in FIGS. 7 to 9, on a lower surface of the mounting plate 81, a pair of rails 82 extending in the X-axis direction are provided at a predetermined interval in the Y-axis direction. A movable stage 83 is provided to the pair of rails 82 and 82 so as to be movable in the X-axis direction.

The electric heat iron 80 is provided on a side of the movable stage 83, which faces the take-up jig 20. An air cylinder 84 serving as an actuator for moving the movable stage 83 with respect to the mounting plate 81 is fixed to the mounting plate 81.

A distal end of a rod 84*a* of the air cylinder 84 is mounted to the movable stage 83.

A through-hole 81*a* is formed in the mounting plate 81 at a position between the pair of rails 82 and 82. To an upper surface of the mounting plate 81, terminal plates 88 are mounted through intermediation of an insulator 88*a*. Conductive plates 89 each curved into a mountain shape are inserted to the through-hole 81*a*. Ends of the conductive plates 89 on one side are connected to the terminal plates 88, and ends of the conductive plates 89 on the other side are connected to the electric heat iron 80.

Lead wires 90 (FIG. 7) from an external power source (not shown) are connected to the terminal plates 88. The electric heat iron 80 is heated with electric power supplied via the conductive plates 89. The curved conductive plates 89 are deformable, and hence do not hinder the movement of the movable stage 83 by the air cylinder 84.

As illustrated in FIG. 6, to the moving plate 58, which is movable in the triaxial directions by the wire retention moving mechanism 54, an abutment piece 86 is provided apart in the X-axis direction from the wire retention clamping device 53.

The abutment piece 86 is provided to the moving plate 58 through intermediation of an air cylinder 87 serving as an actuator for moving the abutment piece 86 in the Y-axis direction. The air cylinder 87 is mounted to the moving plate 58 under a state in which rods 87*a* thereof are directed in the Y-axis direction. The abutment piece 86 is provided at projecting ends of the rods 87*a*. As indicated by two-dot chain lines, in conjunction with projection of the rods 87*a*, the abutment piece 86 is movable up to a position at which the abutment piece 86 is projected from the moving plate 58 in the Y-axis direction with respect to the nipping pieces 53*a* and 53*b* of the wire retention clamping device 53.

The abutment piece 86 is used to hold the core 11 at the time of soldering the wire 12 to the electrode 11*d* or 11*e*. Specifically, the rods 87*a* of the air cylinder 87 are projected to move the abutment piece 86 to the position at which the abutment piece 86 is projected with respect to the nipping pieces 53*a* and 53*b* of the wire retention clamping device 53. In this state, the moving plate 58 is moved with the wire retention moving mechanism 54. Then, as illustrated in FIG. 14, a side surface of the abutment piece 86 is brought into contact with one side in the X-axis direction of each of the flange portions 11*a* and 11*b* of the core 11. The electric heat iron 80 mounted to the support plate 38 is opposed to the other side in the X-axis direction of each of the flange portions 11*a* and 11*b* of the core 11. In this state, the rod 84*a* of the air cylinder 84 is projected to move the movable stage 83, to thereby sandwich the one flange portion 11*a* between the electric heat iron 80 provided to the movable stage 83 and the abutment piece 86. As a result, the electric heat iron 80 heats the wire 12 held in contact with the electrode 11*d* or 11*e*. In this way, the wire 12 can be soldered to the electrode 11*d* or 11*e*.

Next, description is made of operation of the coil manufacturing apparatus.

The coil manufacturing apparatus 10 according to this embodiment performs a wire drawing step of holding and drawing, by a predetermined length, the wire 12 fed from the nozzle 31 of the wire feeding machine, a winding step of rotating the take-up jig 20 together with the core 11 gripped by the chuck 21 of the take-up jig 20 so as to wind the drawn wire 12 around the core 11, an α-winding coil forming step of rotating the nozzle 31 in the same direction as that of the core 11 so as to wind the wire 12 fed from the nozzle 31 around the core 11, to thereby form an α-winding coil 17, a wire cutting step of cutting both ends of the wire 12 wound as the α-winding coil 17 into a predetermined length, and a wire joining step of superimposing and joining the cut wire 12 to the electrodes 11*d* and 11*e* formed on the flange portion 11*a* of the core 11. Now, detailed description is made of those steps.

<Wire Drawing Step>

In this step, the wire 12 to be fed from the nozzle 31 is held and drawn by a predetermined length. The wire 12 is wound around the drum 45. The wire 12 fed from the drum 45 is guided to the wire guide 46*a* at the distal end of the tension bar 46, and is guided from the wire guide 46*a* so as to be inserted through the insertion hole 39*a* of the rotary member 39.

The wire 12 includes what is called an angular wire having a square shape in cross-section (FIG. 14). The wire 12 inserted through the insertion hole 39*a* is guided so as to pass through the feed hole 31*a* of the nozzle 31. As illustrated in FIG. 3, the wire 12 passing through the feed hole 31*a* is drawn in a manner that the end portion thereof is directed obliquely upward. When the end portion is bent obliquely upward, the wire 12 is engaged with a hole rim of the feed hole 31*a*. As a result, the wire 12 is prevented from being pulled back to the tensioning device 42 side.

Although not shown, in the wire drawing step, the wire retention clamping device 53 is moved with the wire retention moving mechanism 54, and the wire 12 fed from the nozzle 31 and bent obliquely upward is gripped with the nipping pieces 53*a* and 53*b*. Then, the wire retention clamping device 53 is moved again with the wire retention moving mechanism 54 so that the wire retention clamping device 53 is spaced away from the nozzle 31. As a result, the wire 12 is drawn from the nozzle 31 by a predetermined length.

As illustrated in FIG. 14, the predetermined length is a length of the wire 12, which is needed for spooling of one coil 17*a* of the α-winding coil 17. At a stage when a length of the drawn wire 12 is adjusted to be substantially equal to this length, the wire retention clamping device 53 is stopped from being moved, and the wire drawing step is finished.

<Winding Step and α-Winding Coil Forming Step>

Description is made of a case where the winding step and the α-winding coil forming step are performed at the same time.

In those steps, after the core 11 is mounted to the take-up jig 20, the take-up jig 20 is rotated. The core 11 is mounted as follows. First, the rod 27*a* of the actuator 27 illustrated in FIG. 1 is projected upward so as to raise the operating rod 26 illustrated in FIG. 5. With this, the upper interval between the fixed side griping member 21*a* and the movable side griping member 21*b* is widened.

After the one flange portion 11*a* of the core 11 is set in a horizontal state on the cutout portion 21*c* of the fixed side griping member 21*a*, the rod 27*a* of the actuator 27 is lowered so as to lower the operating rod 26. The core 11 set horizontally on the cutout portion 21*c* is gripped by the chuck 21 to which the urging force of the coil spring 21*d* is applied.

Then, the core 11 is rotated by the motor 23 mounted to the pedestal 13 illustrated in FIG. 1. Along with the rotation of the core 11, the wire 12 drawn by the wire retention clamping device 53 is wound back around the core 11.

When the winding-back is started, the wire retention moving mechanism 54 brings the wire retention clamping device 53 close to the core 11 at a speed substantially equal to a speed of the wound back wire 12. The wire 12 is prevented from being slackened, and the coil 17*a* to be wound around the core 11 is prevented from swelling.

The coil spring 60 urges the wire retention clamping device 53 in a direction in which the wire retention clamping device 53 is spaced away from the take-up jig 20 so as to absorb errors that may occur between an amount of the winding-back of the wire 12 and a moving amount of the wire retention clamping device 53. In this way, the wire 12 is reliably prevented from being slackened between the wire retention clamping device 53 and the core 11. When being wound back from the wire retention clamping device 53, the wire 12 is wound back along the one flange portion 11*a*, and is wound on the one flange portion 11*a* side of the winding drum portion 11*c*.

As illustrated in FIG. 10, the wire 12 is wound back, and the nozzle 31 is rotated in the same direction at a rotational speed twice as high as that of the core 11 so that a subsequent part of the wire 12 fed from the nozzle 31 is wound around the core 11. In this way, the α-winding coil 17 is formed.

The rotary member 39, to which the nozzle 31 is provided, is moved to a position above the core 11 with the nozzle moving mechanism 33 illustrated in FIG. 2, and a rotation center thereof is aligned with a rotation center of the core 11. In this state, the motor 32 causes the rotary member 39 to be rotated so as to move the nozzle 31 around the core 11.

The nozzle 31 is rotated around the core 11 in the same direction as a rotation direction of the core 11 at the speed twice as high as that of the core 11. Thus, the subsequent part of the wire 12 fed from the nozzle 31 is spooled around the core 11 simultaneously with the wire 12 that is wound back from the wire retention clamping device 53 in a direction indicated by the solid line in FIG. 10. The subsequent part of the wire 12 fed from the nozzle 31 is fed along the another flange portion 11*b*, and wound on the another flange portion 11*b* side of the winding drum portion 11*c*.

As a result, a winding-start portion of the wire 12, which corresponds to a part that is drawn in advance by the wire retention clamping device 53 and is spooled by the rotation of the core 11, and a winding-finish portion of the wire 12, which corresponds to a part that is fed from the nozzle 31 and wound around the core 11, are each positioned on an outermost periphery. In this way, the α-winding coil 17 (FIG. 14) is formed.

<Wire Cutting Step>

In this step, the wire 12 is cut into a predetermined length at parts corresponding to both the ends of α-winding coil 17. The wire 12 is cut with the inner cutter tube 71 and the outer cutter tube 76, and the winding-start portion of the wire 12 and the winding-finish portion of the wire 12 are cut independently of each other.

First, description is made of how the winding-start portion of the wire 12 is cut.

At the time of cutting, the motor 23 mounted to the pedestal 13 causes the inner cutter tube 71 to be rotated together with the core 11 so as to align each side, on which the slits 71*d* are formed, with the Y-axis direction. In this way, positions of the slits 71*d* are aligned with positions of the slits 76*d* of the outer cutter tube 76.

Figure 11:
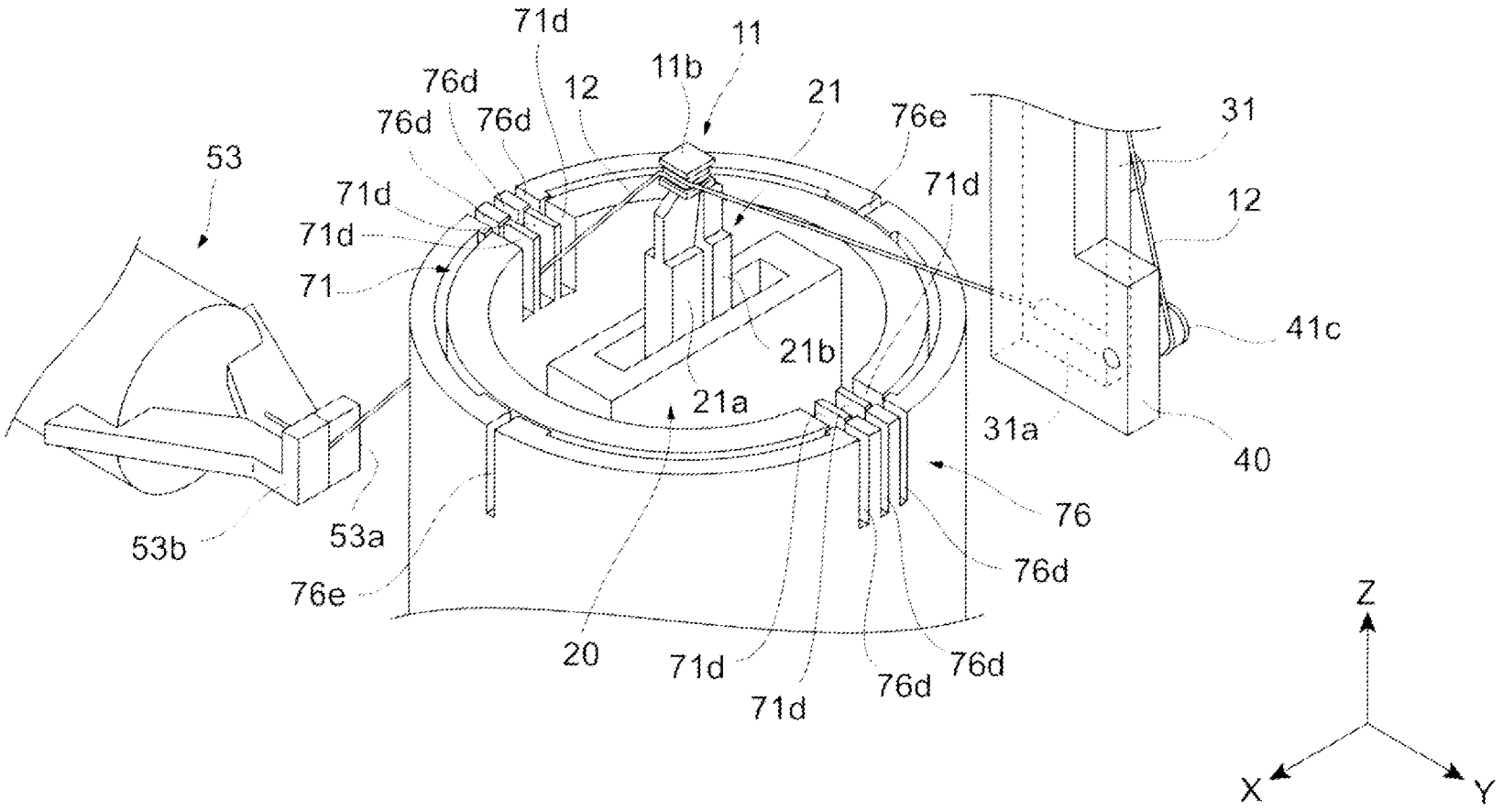
FIG. 11 is a perspective view corresponding to FIG. 10, for illustrating a state in which a winding-start portion of a wire is cut.

In this state, the wire retention clamping device 53 is moved with the wire retention moving mechanism 54 so that, as illustrated in FIG. 11, the winding-start portion of the wire 12, which extends from the wire retention clamping device 53 to the core 11, is caused to pass through the slits 71*d* and 76*d*.

Then, the motor 23 (FIG. 1) causes the inner cutter tube 71 to be slightly rotated so as to displace the slits 71*d* with respect to the slits 76*d* of the outer cutter tube 76. With this, the winding-start portion of the wire 12 is cut.

After that, the wire retention clamping device 53 is moved to a waiting position with the wire retention moving mechanism 54 illustrated in FIG. 1. After the wire retention clamping device 53 is moved to the waiting position, rest of the wire 12 is disposed of.

Next, the winding-finish portion of the wire 12 is cut. In a case where what is called the angular wire is used as the wire 12, the wire 12 is twisted between the drum 45 and the nozzle 31. This is because the wire 12 is spooled by rotating the nozzle 31 in the α-winding coil forming step.

In order to eliminate the twist, after the winding-start portion of the wire 12 is cut, the nozzle 31 is rotated together with the core 11 in a direction reverse to that at the time of the spooling. In this way, the twist is eliminated. The number of the rotations is the same as that at the time of the spooling. When the nozzle 31 is rotated together with the core 11, the wire 12 wound around the core 11 is prevented from being loosened. After the twist is eliminated, the winding-finish portion of the wire 12 is cut at a position between the core 11 and the nozzle 31.

Figure 12:
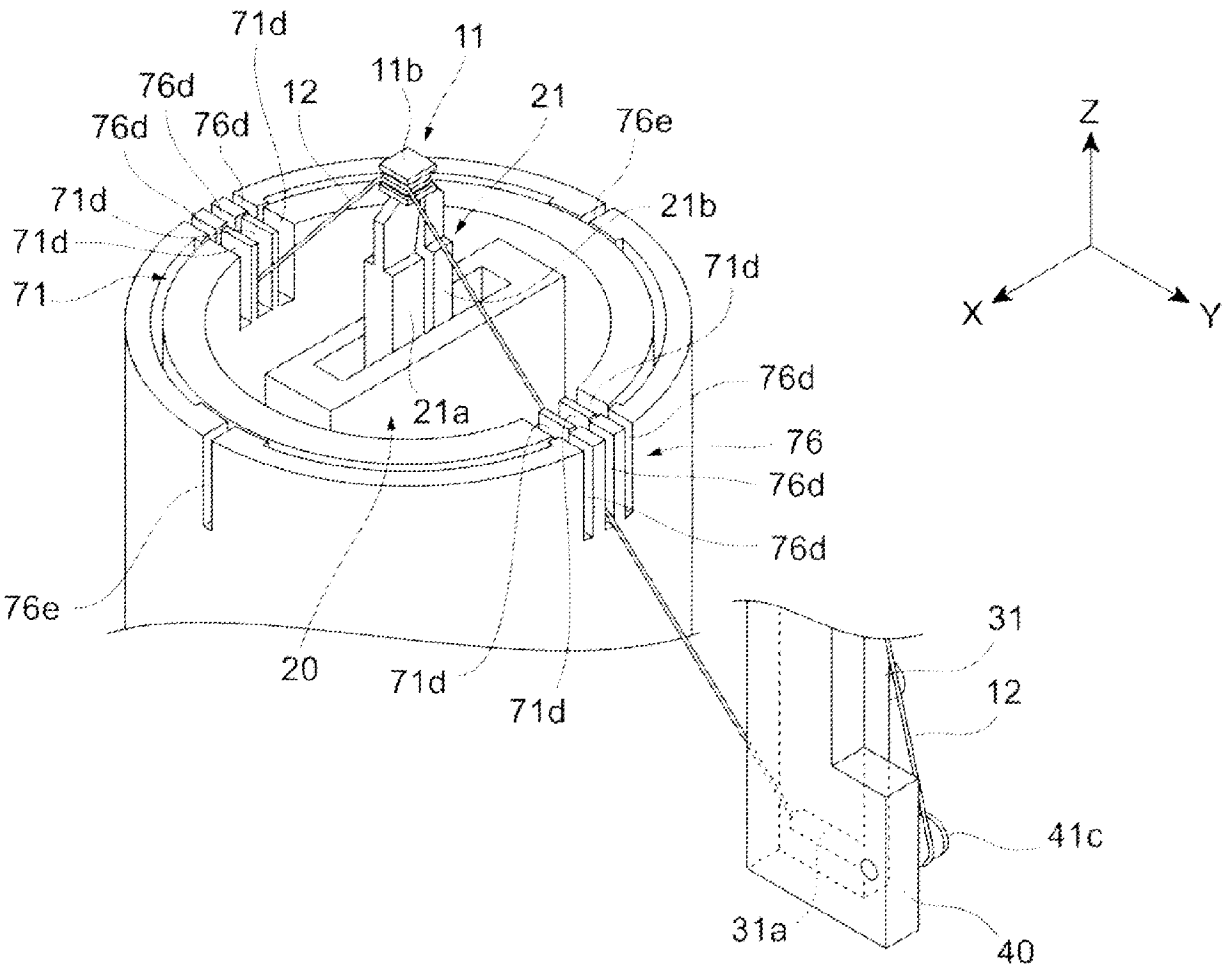
FIG. 12 is a perspective view corresponding to FIG. 10, for illustrating a state in which a winding-finish portion of the wire is cut.

Also at the time of cutting the winding-finish portion of the wire 12, as illustrated in FIG. 12, the slits 71*d* of the inner cutter tube 71 are aligned with the slits 76*d* of the outer cutter tube 76. In this state, the nozzle 31 is moved with the nozzle moving mechanism 33 (FIG. 1) so that the winding-finish portion of the wire 12, which extends from the nozzle 31 to the core 11, is caused to pass through the slits 71*d* and 76*d*.

At this time, the wire 12 passing through the feed hole 31*a* of the nozzle 31 is drawn with the wire 12 being directed obliquely upward. Then, the motor 23 (FIG. 1) causes the inner cutter tube 71 to be slightly rotated so as to displace the slits 71*d* with respect to the slits 76*d* of the outer cutter tube 76. As a result, the winding-finish portion of the wire 12 is cut into a predetermined length.

Then, the nozzle 31 is moved to a waiting position with the nozzle moving mechanism 33. It should be noted that, as illustrated in FIG. 3, the wire 12 passing through the feed hole 31*a* of the nozzle 31 is drawn with the end portion thereof being obliquely upward. Thus, the wire 12 is engaged with the hole rim of the feed hole 31*a*, and is not pulled back to the tensioning device 42 side until subsequent spooling is performed.

<Wire Joining Step>

In this step, the cut wire 12 is superimposed on the electrodes 11*d* and 11*e* of the flange portion 11*a* of the core 11 and joined thereto. The superimposition and joining are performed on the cut winding-start portion of the wire 12 and the cut winding-finish portion of the wire 12 independently of each other.

First, description is made of superimposition and joining of the cut winding-start portion of the wire 12.

Figure 13:
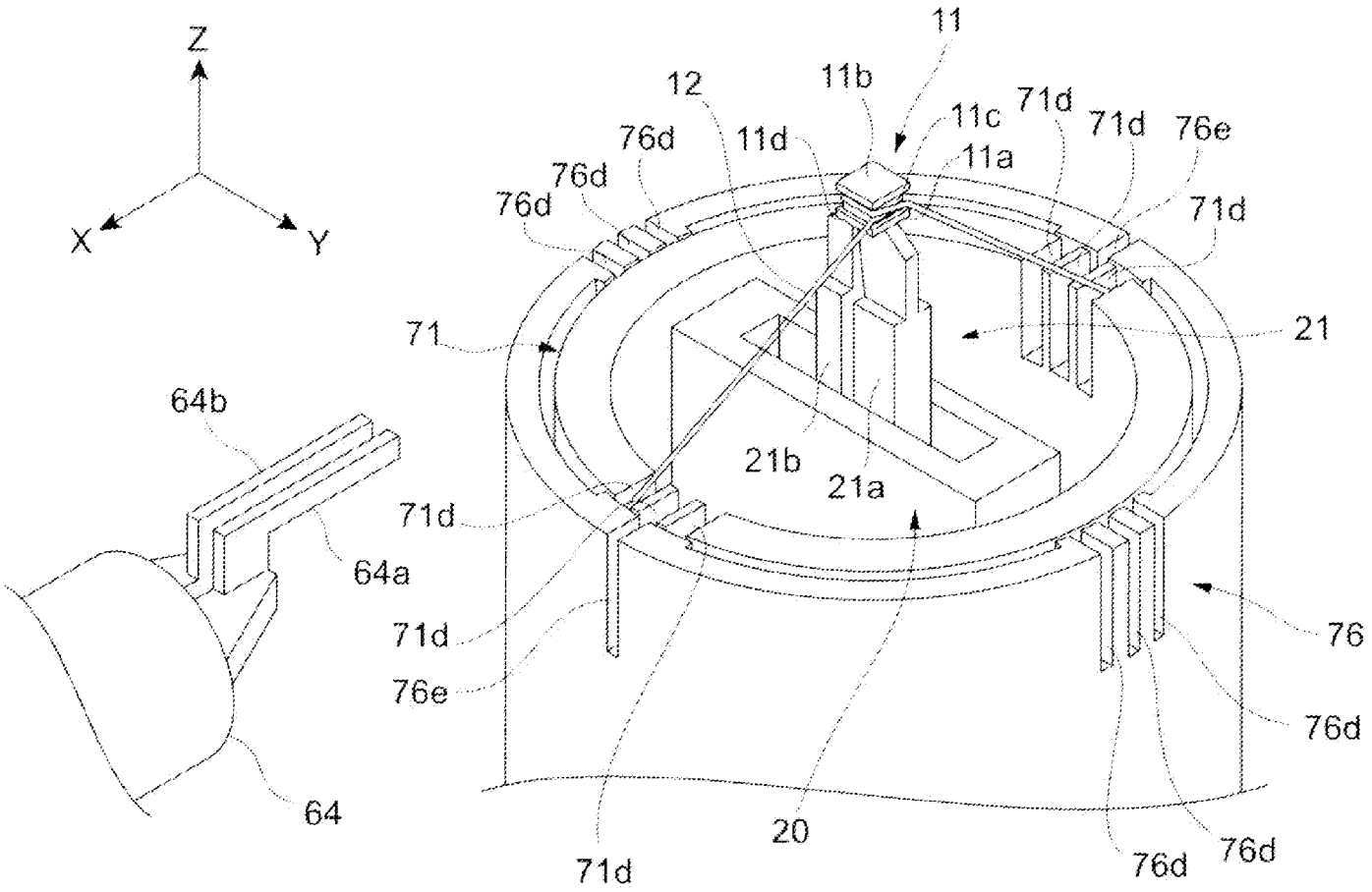
FIG. 13 is a perspective view corresponding to FIG. 10, for illustrating a state in which the cut winding-start portion of the wire is opposed to a routing clamp device.

At the time of superimposing the cut winding-start portion of the wire 12, the motor 23 mounted to the pedestal 13 causes the inner cutter tube 71 to be rotated together with the core 11 so as to align, as illustrated in FIG. 13, the slit 71*d* receiving the winding-start portion of the wire 12 with the X-axis direction. With this, the cut winding-start portion of the wire 12, which is received in the slit 71*d*, is moved to a position at which the cut winding-start portion of the wire 12 is opposed to the end portion clamping device 64.

The end portion clamping device 64 is moved with the moving mechanism 65 (FIG. 2) so that the winding-start portion of the wire 12, which extends from the core 11 to the slit 71*d*, is gripped with the nipping pieces 64*a* and 64*b*. Then, the end portion clamping device 64 is moved with the moving mechanism 65 so that, as illustrated in FIG. 14, the winding-start portion of the wire 12, which extends from the end portion clamping device 64 to the core 11, is pressed and superimposed onto the electrode 11*d* formed on the one flange portion 11*a*.

In this state, the cut winding-start portion of the wire 12 is joined to the electrode 11*d*. The joining is performed with the electric heat iron 80 serving as the joining means. Specifically, the rods 87*a* of the air cylinder 87 illustrated in FIG. 6 are projected to move the abutment piece 86 to the position indicated by the two-dot chain lines. In this state, the abutment piece 86 is moved together with the moving plate 58 with the wire retention moving mechanism 54 so that, as illustrated in FIG. 14, the side surface of the abutment piece 86 is brought into contact with the one side in the X-axis direction of each of the flange portions 11*a* and 11*b* of the core 11.

Then, the support plate 38 is moved with the nozzle moving mechanism 33 illustrated in FIG. 2 so that the electric heat iron 80 mounted to the support plate 38 is opposed to the other side in the X-axis direction of each of the flange portions 11*a* and 11*b* of the core 11. In this state, the rod 84*a* of the air cylinder 84 is projected to move the movable stage 83 so that the electric heat iron 80 provided to the movable stage 83 is moved as indicated by the solid arrow in FIG. 14. The one flange portion 11*a* of the core 11 is sandwiched between the electric heat iron 80 and the abutment piece 86. As a result, the winding-start portion of the wire 12, which is superimposed on the electrode 11*d*, is soldered to the electrode 11*d* by the heated electric heat iron 80.

While the electric heat iron 80 is pressed onto the winding-start portion of the wire 12, the end portion clamping device 64 gripping the winding-start portion of the wire 12 is moved with the moving mechanism 65 so that the wire 12 is torn off in a vicinity of the electric heat iron 80. The winding-start portion of the wire 12 is joined to the electrode 11*d*, and the rest of the wire 12 is disposed of after the end portion clamping device 64 is moved to a waiting position.

Next, superimposition and joining of the winding-finish portion of the wire 12 are performed by the same procedure as the above-mentioned procedure of the superimposition and joining of the winding-start portion of the wire 12. After the winding-start portion of the wire 12 is joined, the motor 23 mounted to the pedestal 13 causes the inner cutter tube 71 to be rotated at approximately 180 degrees together with the core 11 so as to oppose the cut winding-finish portion of the wire 12, which is received in the slit 71*d*, to the end portion clamping device 64.

After that, the end portion clamping device 64 is moved with the moving mechanism 65 so that the winding-finish portion of the wire 12, which extends from the core 11 to the slit 71*d*, is gripped with the nipping pieces 64*a* and 64*b*. In this state, the end portion clamping device 64 is moved with the moving mechanism 65 so that the winding-finish portion of the wire 12, which extends from the end portion clamping device 64 to the core 11, is pressed and superimposed onto the electrode 11*e* formed on the one flange portion 11*a*.

In this state, the cut winding-finish portion of the wire 12 is joined to the electrode 11*e*. The joining is performed by the same procedure as the procedure for joining the winding-start portion of the wire 12 to the electrode 11*d*, and hence description thereof is omitted.

While the electric heat iron 80 is pressed onto the winding-finish portion of the wire 12, the end portion clamping device 64 gripping the winding-finish portion of the wire 12 is moved with the moving mechanism 65 so that the wire 12 is torn off in the vicinity of the electric heat iron 80. The winding-finish portion of the wire 12 is joined to the electrode 11*e*, and the rest of the wire 12 is disposed of after the end portion clamping device 64 is moved to the waiting position.

According to the embodiment described above, the following advantages are obtained.

The cylindrical inner cutter tube 71 to be rotated together with the take-up jig 20, and the immovable outer cutter tube 76 provided so as to be superimposed on the outside of the inner cutter tube 71 are provided. Thus, when the inner cutter tube 71 is rotated together with the take-up jig 20 so that the first slits 71*d* formed in the inner cutter tube 71 and the second slits 76*d* formed in the outer cutter tube 76 are aligned with each other, the first slits 71*d* and the second slits 76*d* aligned with each other allow the wire 12 to be inserted therethrough. Then, the inner cutter tube 71 is rotated together with the take-up jig 20, and hence the slits 71*d* are moved in a circumferential direction relative to the slits 76*d*. Thus, the wire 12 inserted through both the slits 71*d* and the slits 76*d* is cut between the inner cutter tube 71 and the outer cutter tube 76.

In this way, the coil manufacturing apparatus 10 according to the embodiment of the present invention does not need the nipper device and the triaxial movement mechanism that are needed for cutting the wire 12 in the related art, and the mechanism needed for cutting the wire 12 is provided around the take-up jig 20. Thus, the apparatus as a whole can be downsized.

Further, the inner cutter tube 71 and the outer cutter tube 76 for cutting the wire 12 are cylindrical members provided around the take-up jig 20. The inner cutter tube 71 is rotated by the mechanism for rotating the take-up jig 20, and hence an independent rotary mechanism for rotating the inner cutter tube 71 is not even needed. In this way, the winding-start portion or the winding-finish portion of the wire 12 of the coil 17 can be swiftly cut into a predetermined length, and the mechanism for cutting the wire 12 can be downsized.

Further, the nozzle 31 is rotated in the same direction at a speed higher than the rotational speed of the core 11 rotated by the take-up jig 20 so that both the wire 12 fed from the nozzle 31 and the wire 12 retained in the wire retaining mechanism 52 are taken up around the core 11 gripped by the take-up jig 20. Thus, the α-winding coil 17 having the winding-start portion and the winding-finish portion of the wire 12 each positioned on an outer periphery of the α-winding coil 17 can be manufactured. Also in the case of manufacturing such an α-winding coil 17, the winding-start portion or the winding-finish portion of the wire 12 can be swiftly cut into a predetermined length.

Further, an outer radius of the inner cutter tube 71 and an inner radius of the outer cutter tube 76 are each equal to a length from a center of the coil 17 to each of the positions at which the wire 12 is cut. Thus, a cutting length of the wire 12 can be easily changed by changing the outer radius of the inner cutter tube 71 and the inner radius of the outer cutter tube 76.

It should be noted that, in the case of the embodiment described above, the α-winding coil 17 is manufactured by rotating the nozzle 31 at the speed higher than the rotational speed of the core 11, but the α-winding coil having the winding-start portion and the winding-finish portion of the wire 12 each positioned on the outer periphery of the α-winding coil may be manufactured by rotating the wire retention clamping device 53 serving as the wire retaining mechanism 52 with a rotary mechanism in the same direction at the speed higher than the rotational speed of the core 11 rotated by the take-up jig 20. Also in this case, the winding-start portion or the winding-finish portion of the wire can be swiftly cut into a predetermined length with the inner cutter tube 71 and the outer cutter tube 76.

Further, in the embodiment described above, description is made of the nozzle moving mechanism 33, the wire retention moving mechanism 54, and the moving mechanism 65 each including the extension/retraction actuators that are extendable and retractable in the X-axis, the Y-axis, and the Z-axis directions. However, the structure of those mechanisms is not limited to the structure described above, and may include structures of other types as long as objects thereof can be moved in the triaxial directions.

Still further, the wire 12 used in the case of the embodiment described above is what is called the angular wire having a square shape in cross-section, and has an insulating coating that can be soldered with the electric heat iron 80. However, the wire 12 is not limited to the angular wire, and may include wires having a rectangular shape or a polygonal shape in cross-section, or a round wire having a circular shape in cross-section. Alternatively, the wire 12 may include a coated conductive wire having an insulating coating to be self-fused. When the coated conductive wire to be self-fused is used as the wire 12, deformation of the α-winding coil 17 to be manufactured can be prevented.

Yet further, in the case of the embodiment described above, the winding step and the α-winding coil forming step are performed at the same time. Specifically, in order to form the α-winding coil 17, the core 11 is rotated so that the drawn wire 12 is wound around the core 11, and the nozzle 31 is rotated in the same direction at the rotational speed twice as high as that of the rotation of the core 11 so that the wire 12 fed from the nozzle 31 is wound around the core 11. However, the α-winding coil forming step may be performed after the winding step.

Specifically, there is performed a winding step of rotating the core 11 and simultaneously rotating the nozzle 31 in the same direction at the same rotational speed as the rotational speed of the core 11 so as to wind the drawn wire 12 around the core 11, to thereby form the one coil 17*a* first. Then, there is performed an α-winding coil forming step of stopping the rotation of the core 11 while continuing the rotation of the nozzle 31 so as to wind the wire 12 fed from the nozzle 31 around the core 11 that has been stopped from rotating, to thereby form another coil 17*b* adjacently to the one coil 17*a*. In this way, the α-winding coil forming step may be performed after the winding step.

Embodiments of the present invention were described above, but the above embodiments are merely examples of applications of the present invention, and the technical scope of the present invention is not limited to the specific constitutions of the above embodiments.

This application claims priority based on Japanese Patent Application No. 2013-83553 filed with the Japan Patent Office on Apr. 12, 2013, the entire contents of which are incorporated into this specification.

The invention claimed is:

1. A coil manufacturing apparatus, comprising:

a nozzle configured to feed a wire;

a take-up jig configured to take up, through rotation, the wire fed from the nozzle;

a cylindrical inner cutter tube that is provided coaxially with the take-up jig and is configured to rotate together with the take-up jig, the cylindrical inner cutter tube comprising a first slit that is formed so as to extend in an axial direction, the first slit being configured so that the wire is inserted through; and an immovable outer cutter tube that is provided so as to be superimposed in a radial direction on an outside of the cylindrical inner cutter tube, the immovable outer cutter tube comprising a second slit that is formed so as to extend in the axial direction, the second slit being configured so that the wire is inserted through, wherein a part of the wire inserted through the first slit and the second slit is cut by moving the first slit with respect to the second slit.

2. The coil manufacturing apparatus according to claim 1, further comprising:

a wire retaining mechanism configured to draw and retain the wire from the nozzle by a length corresponding to a predetermined number of turns; and a rotary mechanism configured to rotate the nozzle or the wire retaining mechanism around the take-up jig, wherein the rotary mechanism is configured to rotate the nozzle or the wire retaining mechanism in a direction that is the same as a rotational direction of the take-up jig at a speed higher than a rotational speed of the take-up jig so that both a portion of the wire fed from the nozzle and a portion of the wire retained by the wire retaining mechanism are taken up around the take-up jig.

3. A coil manufacturing apparatus, comprising:

a nozzle configured to feed a wire;

a take-up jig configured to take up, through rotation, the wire fed from the nozzle;

a cylindrical inner cutter tube that is provided coaxially with the take-up jig and is configured to rotate together with the take-up jig, the cylindrical inner cutter tube comprising a first slit that is formed so as to extend in an axial direction, the first slit being configured so that the wire is inserted through;

an immovable outer cutter tube that is provided so as to be superimposed in a radial direction on an outside of the cylindrical inner cutter tube, the immovable outer cutter tube comprising a second slit that is formed so as to extend in the axial direction, the second slit being configured so that the wire is inserted through; and a motor for rotating the inner cutter tube with respect to the outer cutter tube so as to displace the first slit with respect to the second slit to cut the wire.

4. The coil manufacturing apparatus according to claim 3, wherein the inner cutter tube rotates together with the take-up jig.

* * * * *